United States Patent [19]

Spauschus

[11] 4,417,451

[45] Nov. 29, 1983

[54] VAPOR COMPRESSION REFRIGERANT SYSTEM MONITOR AND GAS REMOVAL APPARATUS

[75] Inventor: Hans O. Spauschus, Atlanta, Ga.

[73] Assignee: Hilliard-Lyons Patent Management, Inc.

[21] Appl. No.: 339,855

[22] Filed: Jan. 18, 1982

Related U.S. Application Data

[63] Continuation-in-part of Ser. No. 147,691, May 7, 1980, Pat. No. 4,316,364.

[51] Int. Cl.[3] ..... F25B 43/04; G01K 13/00

[52] U.S. Cl. ..... 62/129; 62/475; 62/85

[58] Field of Search ..... 62/84, 85, 195, 474, 62/475, 129; 55/158, 16

[56] References Cited

U.S. PATENT DOCUMENTS

| | | | |
|---|---|---|---|
| 1,636,512 | 7/1927 | Hilger | 62/195 X |
| 1,738,720 | 12/1929 | Munters et al. | 55/158 X |
| 2,363,440 | 11/1944 | Roswell | 62/195 |
| 2,627,933 | 2/1953 | Teter | 55/158 |
| 2,767,554 | 10/1956 | Ormes | 62/195 |

FOREIGN PATENT DOCUMENTS

| | | | |
|---|---|---|---|
| 55-97223 | 7/1980 | Japan | 55/16 |

*Primary Examiner*—Albert J. Makay
*Assistant Examiner*—Harry Tanner

[57] ABSTRACT

A monitor for a vapor compression refrigerant system using halocarbon refrigerants that accumulates contaminant gases present or generated in an operating system and provides a readout indicative of the presence of significant amounts of contaminant gases which readout serves to provide an indication of an incipient malfunction of the refrigerant system. Embodiments of the monitor are disclosed which provide continuous and automatice purging of the contaminant gases from the system using perm-selective membranes with or without provision for providing indicia of the presence or build-up of contaminant gases in the monitor.

9 Claims, 4 Drawing Figures

VAPOR COMPRESSION REFRIGERANT SYSTEM MONITOR AND GAS REMOVAL APPARATUS

CROSS REFERENCE TO RELATED APPLICATION

This application is a continuation-in-part of copending application Ser. No. 147,691, filed May 7, 1980, now U.S. Pat. No. 4,316,364 in the name of H. O. Spauschus and entitled "Vapor Compression Refrigerant System Monitor".

BACKGROUND OF THE INVENTION

This invention relates to the monitoring of a halocarbon vapor compression refrigerant system and more specifically to apparatus which is adapted to respond to the presence of non-condensable contaminant gases in the system to purge them from the system and which may also advantageously provide an indication of the onset of a system malfunction in time to initiate corrective action before actual system breakdown occurs.

Refrigerant systems of the type which can advantageously employ the present invention are those used in air conditioners, heat pumps, commercial food refrigeration systems and the like, which employ a sealed refrigerant circuit comprised of a refrigerant compressor, a condenser, an evaporator and a fluid expansion device, such as an expansion valve or a capillary tube, connected between the condenser and the evaporator. Such systems may also include a filter-drier to remove particulate contaminants and to control the moisture content of the circulating refrigerant. Such systems may also include a receiver for controlling and metering the flow of liquid refrigerant from the condenser and an accumulator located upstream of the suction line leading to the compressor, the purpose of the receiver being to store excess liquid refrigerant in the system and to avoid influx of the liquid refrigerant to the compressor during start-up.

Systems of the type just described are called hermetic systems or semi-hermetic systems because they are designed to operate most effectively by the rigorous exclusion of air or other contaminant gases in the sealed system. Hermetic systems are thoroughly evacuated during the final stages of manufacture and are permanently sealed, usually by soldering or brazing, after the refrigerant charge is introduced into the unit. Some air conditioners and heat pumps are installed as split systems, requiring final assembly in the field. In these systems, the internal heat exchanger is remote from the compressor unit, which is located outside of the structure or dwelling to be conditioned. In the installation of these split systems, precautions for eliminating contaminant gases are exercised, though these are not as effective as those employed in factory sealed hermetic systems. Semi-hermetic systems are generally larger systems with provisions for unbolting the compressor case to facilitate replacement of compressor parts or the hermetic motor, if such repair is necessary. In systems of this type, the vapor compression or refrigerant circuit is designed to operate with only the halocarbon working fluid and selected lubricating oil charged into the sealed system.

For larger systems, particularly for industrial or commercial engineered refrigeration systems, means for purging the system of contaminant gases may be required. If the system operates below atmospheric pressure, any leaks such as through gaskets and seals will permit entry of air into the refrigerant system. Surge-type receivers have been used in the design of these halocarbon refrigerant systems and these are often provided with a purge valve on the condenser to facilitate removal of contaminant gases. When these purge valves are opened to release contaminant gases, loss of halocarbon refrigerant also is likely since there is no means for separation of the gases released from the system. Loss of refrigerant may be harmful to the operation of the system, if the system is charge sensitive, and inadvertent discharging of certain refrigerants to the atmosphere may have harmful environmental consequences.

Systems utilizing ammonia as refrigerant fluid have employed a non-condensable gas separator as an accessory, as illustrated, for example, in U.S. Pat. No. 1,636,512. These types of purge units tend to be complex assemblies of drums, coils, valves and piping connections, however, and are not known to be employed in halocarbon refrigerant systems.

Practical experience with many sealed refrigeration systems operating over long periods has demonstrated that properly designed and installed vapor compression systems are free from contaminant gases. In those instances when contaminant gases are present, they may interfere with the performance or reliability of the system. The presence of non-condensable gases in vapor compression systems results in reduced efficiency or, in more severe cases, in catastrophic failure of the motor-compressor. Reduced efficiency results because the compressor circulates non-condensable gases through the system which results in non-productive work being performed.

Sources of contaminant gases in vapor compression systems are several. A likely source arises from incomplete evacuation of air and this source is most pronounced in field assembled split-systems. Even when evacuation is very thorough, some materials of construction continue to outgas at a slow rate for some time after evacuation pumping has ceased. Another source of contaminant gases arises from low side leaks. Although hermetic systems are carefully leak-checked during assembly, very small leaks sometimes escape detection. If these leaks are located in the low pressure side of the system and if the system design is such that the low side operating pressure is less than atmospheric pressure, air will be drawn into the sealed system at a rate determined by the pressure differential and the size of the leak. A final source of contaminant gases arises from decomposition products generated inside the refrigerant system if the system, and particularly the motor-compressor unit, is allowed to operate at conditions of high temperature or marginal lubrication. It is known that larger quantities of these products are produced as operating conditions become more severe and that, ultimately, system failure will result.

Systems of the type described above generally are operated with no provision for determining incipient malfunctions in the system, although a moisture indicator has been used in some installations. Typically, the system is operated until system breakdown occurs at which time repair service is initiated to put the system back into operation. The down time that results from this kind of reactive maintenance program is, at best, an inconvenience for the system user and can often be very costly in terms of such things as food spoilage, as in the case of commercial food refrigeration systems. It is, therefore, desirable to provide apparatus that will monitor the operation of the refrigerant system on an ongoing basis to provide an indication of the onset of a system malfunction caused by the presence of non-condensable contaminant gases and/or to purge the system of such gases to realize more efficient system operation and to minimize maintenance requirements.

It is therefore an object of the invention to provide a monitor for a halocarbon vapor compression refrigerant system that provides for in-situ indication of an incipient malfunction in the system's operation caused by the presence of non-condensable contaminant gases.

It is a further object of the invention to provide apparatus that will continuously and automatically monitor the halocarbon refrigerant system for the presence of non-condensable contaminant gases and remove them from the system without undesired removal of the halocarbon fluid.

It is yet a further object of the invention to provide apparatus which is capable of continuously and automatically monitoring a halocarbon refrigerant system to purge the refrigerant circuit of contaminant gases and simultaneously providing an indication of the presence and build-up of the contaminant gases so as to serve as a warning of an incipient malfunction requiring repair service before breakdown occurs.

It is a still further object of the invention to provide apparatus of the type described which is simple to implement and does not require highly skilled technicians in the field to operate and maintain.

SUMMARY OF THE INVENTION

Therefore, in accordance with the invention, there is provided apparatus for a halocarbon vapor compression refrigerant system having a refrigerant flow circuit including a compressor, a condenser, fluid expansion means and an evaporator, the apparatus comprising a gas accumulating means having an inlet port coupled in fluid communication with the refrigerant flow circuit on the high pressure side at a point to which non-condensable contaminant gases in the refrigerant stream migrate during operation of the system. There is included in the gas accumulating means a perm-selective membrane adapted to selectively pass predetermined contaminant gas compositions and remove them from the refrigerant circuit to the exclusion of the halocarbon vapor in the circuit. In one form of the invention, there is also included in the apparatus indicia means responsive to the accumulation of gases in the gas accumulating means to provide indicia representative of the degree of accumulation of the contaminant gases which have permeated through the membrane, whereby an in-situ indication of the onset of a system malfunction is provided. In one preferred form of the invention, the membrane is positioned in the gas accumulating means at a point space away from the inlet port to form an intermediate gas accumulating chamber adjacent the inlet port and generally at the same pressure level as the refrigerant circuit but out of the main flow stream of the refrigerant circuit thus to serve as a holding chamber for the gases to improve the efficiency of their permeation through the membrane as compared to the permeation that would result if the membrane were located directly at the inlet port or other point of juncture to the refrigerant circuit.

DETAILED DESCRIPTION

Figure 1:
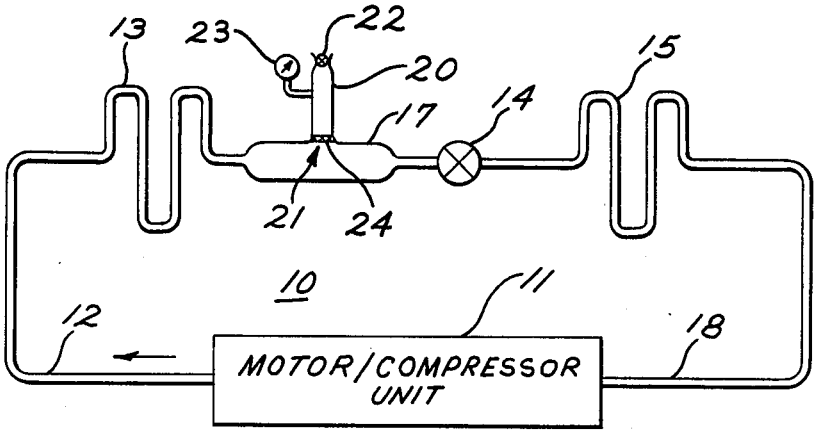
FIG. 1 is a schematic diagram of a representative refrigerant circuit illustrating one embodiment of apparatus made in accordance with the present invention.

Referring to FIG. 1, a refrigerant circuit 10 is shown generally in schematic form as including hermetic motor-compressor unit 11, condenser 13, and evaporator 15. Condenser 13 is connected on its inlet side to the high side of compressor 11 via connecting tubing 12 and on its outer side via a device 17, such as a filter-drier or receiver, to fluid expansion means 14. Fluid expansion means 14 may take the form of a fluid expansion valve or a capillary tube and serves both as a fluid expansion and metering device in known manner. The fluid expansion device outlet is connected to the evaporator 15 and then through suction line 18 to the low side of the motor-compressor unit 11. As previously explained, the filter-drier or receiver acts as a holding vessel for liquid refrigerant and may also provide a suitable space where non-condensable contaminant gases can collect. For the purpose of the following description, it will be assumed that device 17 is a receiver.

In accordance with one embodiment of the invention, as illustrated in FIG. 1, a gas accumulating chamber 20 is formed on the upper surface of liquid receiver 17 and is in open communication with the refrigerant stream flowing through receiver 17 via an inlet port 21. An outlet bleed or purge valve 22 is provided to serve as a convenient means of discharging gas accumulated in chamber 20 when it is desired to do so. A feature of the present invention is that a perm-selective membrane 24 is provided in the chamber 20 to selectively pass the non-condensable contaminant gases out of the main flow stream of the refrigerant circuit without significant loss of the halocarbon vapor. As shown by way of example in FIG. 1, the membrane 24 is secured in suitable pressure sealed, airtight manner across the inlet port 21, thus admitting only contaminant gases into chamber 20. Although not shown, it will be appreciated that a suitable support layer such as a screen or a plug of porous ceramic material may be employed to support the perm-selective membrane 24 against the pressure of the refrigerant circuit.

Further in accordance with the illustrated embodiment of the invention, means, such as a pressure gauge 23, may be secured to the side of chamber 20 in communication with the interior chamber to provide indicia which is representative of the build-up and presence of contaminant gases in chamber 20. Initially, the pressure in chamber 20 is at atmospheric pressure due to previous opening of purge valve 23. The permeation of gases through membrane 24 causes the pressure reading to increase accordingly to thus indicate the presence of contaminant gases. As will be explained, the presence of contaminant gases in chamber 20 provides an in-situ indication of the onset of a refrigerant system malfunction which can be identified and repaired using routine service procedures prior to the occurrence of complete system breakdown or failure.

Vapor compression refrigerant systems, as is known, perform their heating or cooling function through liquifaction of a condensable refrigerant by means of a mechanical compressor. During the manufacturing process, systems are thoroughly evacuated to remove residual air and moisture, then helium leak tested and charged with the selected refrigerant, which in the case of the present invention would be a halocarbon, typically R11, R22, R12, R502, R113 or R114. Following this, the system is permanently sealed to isolate the refrigeration unit from the outside atmosphere. It is well known that thorough elimination of residual gases is required to assure long and reliable operation of the system. It has also been established that very small amounts of new gaseous decomposition products will be generated inside the refrigerant system if the system, and particularly the motor-compressor unit, is allowed to operate at conditions of high temperature or marginal lubrication. In most instances, these gaseous products are present at such low concentration (parts per million) relative to the refrigerant, that they do not interfere with the performance or reliability of the system. As operating conditions become more severe or marginal, however, larger quantities of gaseous products are produced and the system will ultimately become inoperable. Knowledge of the nature and amount of gaseous contaminants in a system, and the rate at which such contaminants are generated, can provide an early signal that a vapor compression system is not operating properly, i.e. an incipient malfunction is present. Analysis of the contaminant gases can provide an indication as to the nature of the problem that exists which can lead to appropriate corrective action and avoidance of catastrophic failure through complete system breakdown. Even when a complete gas analysis is not possible to determine the exact nature of the fault, the indication of the presence of contaminant gases nonetheless does serve as an early warning which provides an opportunity to replace a marginal motor-compressor unit on a planned basis rather than on an emergency basis.

The composition and design of the barrier material used for membrane 20 are chosen using known techniques so that the material will preferentially permit the non-condensable gases to pass through while containing the halocarbon working fluid. The rate of permeation of gases through different media is known to vary widely depending on the nature of the gas, the composition and dimensions of the barrier material and the temperature and pressure of the gas. The molecular structure and chemical properties of halocarbons are markedly different from those of the gaseous contaminants (oxygen, nitrogen, carbon monoxide, carbon dioxide, hydrogen and low molecular weight hydrocarbons) found in hermetic and semi-hermetic systems. Based on these differences, preferred classes of barrier materials can be and have been identified which are known to exhibit a high permeability to contaminant gases with acceptably low permeability to the halocarbon working fluid.

The selected barrier material must have a suitably low permeability for halocarbon refrigerant so that refrigerant losses through the membrane 24 are at an acceptable minimum. The permeability constant, P, is expressed in terms of the cubic centimeters (at standard temperature and pressure) of the gas, per second, that permeates through a square centimeter of the barrier material, one millimeter thick and at a gas pressure of one centimeter of mercury. For a barrier surface of 1 square centimeter, 1 millimeter thick and for refrigerant R12 at a pressure of 225 psi, the refrigerant leakage rate is given in Table I.

TABLE I

| P | Grams R12 per 10 year period | % of Charge Typical 5 Ton Unit |
|---|---|---|
| $10^{-6}$ | 197 | 4.3% |
| $10^{-8}$ | 1.97 | 0.043% |
| $10^{-10}$ | 0.0197 | 0.00043% |

A permeability constant of $10^{-8}$ or less would assure a negligible loss of refrigerant R12 over a 10 year period.

The selected barrier material must have a suitably high permeability for non-condensable gases to assure their expeditious removal from the circulating refrigerant stream. For a barrier surface of 1 square centimeter, 1 millimeter thick and at a pressure of 225 psi, permeation times for 200 standard cubic centimeters of non-condensable gas have been determined at various permeation constants, as shown in Table II.

TABLE II

| P | Time |
|---|---|
| $1.45 \times 10^{-6}$ | 14 days |
| $1.45 \times 10^{-5}$ | 1.4 days (33 hours) |
| $1.45 \times 10^{-4}$ | 0.14 days (3.3 hours) |

A permeability constant of $10^{-6}$ or greater is desired for removal of 200 standard cubic centimeters of non-condensable gas in 14 days or less.

Barrier materials that serve as candidates for separation of non-condensable gases and halocarbon refrigerants include glasses, ceramics, polymeric materials such as plastics, films and elastomers, natural products such as cellulose and rubber as well as porous metals or metal films, such as stainless steel, palladium, platinum and cold rolled steel. Taken singly or in combination these materials provide a wide latitude of desired permeation rates. For example, it is known that the process of permeation through glass is highly selective and that the permeation rate of air through porcelain can be made to vary over wide ranges by glazing. Recently developed ceramic processing techniques involving chemical polymerization of sol-gel alumina, on heat treating, produce a ceramic with narrow pore size distribution and a mean pore radius determined by process parameters. Studies of polymeric film materials have established that wide ranges of halocarbon permeation are available for different types of films and for various film combinations or treatments. For example, a range of permeability constants from $10^{-8}$ to less than $10^{-11}$ for refrigerant R12 has been reported. This selection of barrier materials with a wide range of permeability constants provides the opportunity to tailor the construction of the purge device to match selected system size and refrigerant for optimum performance.

Figure 2:
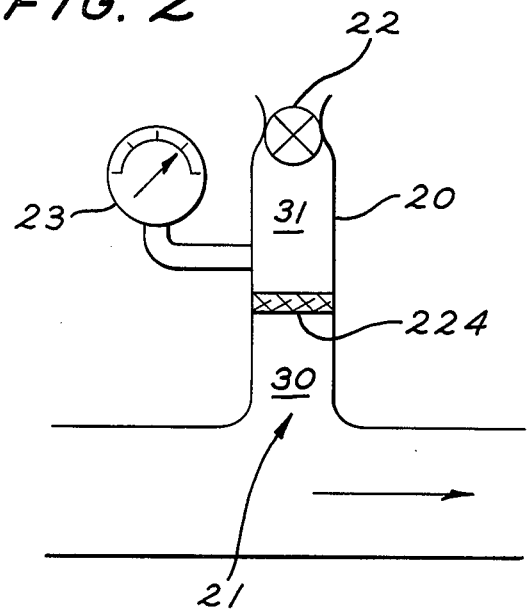
FIGS. 2–4 each illustrate alternative embodiments of apparatus constructed in accordance with the present invention.
Figure 3:
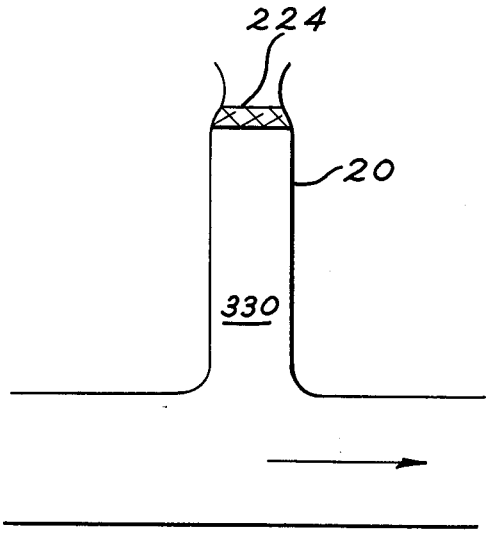

In FIG. 2, an improved form of the invention is shown in which the perm-selective membrane 224 is spaced away from inlet port 21 to form an intermediate gas accumulating chamber 30 adjacent inlet port 21 but out of the main stream of the refrigerant circuit. With this arrangement, the contaminant gases are more readily collected and put in residence next to membrane 224 for the dwell time needed for the permeation of the gas through the membrane to occur. With the arrangement as shown in FIG. 2, a second chamber 31 is formed by locating membrane 224 intermediate inlet port 21 and the distal or remote end of chamber 20 wherein purge valve 22 is located. By means of a pressure gauge 23, attached to gas accumulating chamber 20 so as to be in communication with the second chamber 31, the build-up of contaminant gases in chamber 31 be detected in the same manner as FIG. 1 to give an indication of incipient malfunction of the refrigerant system. It will be appreciated that the inclusion of indicia means, such as pressure gauge 23, may not be desired and that only continuous and automatic purging of the contaminant gases is needed. In such event, pressure gauge 23 may be omitted and chamber 31 then can be purged of built-up gases by routine opening of purge valve 22 on a periodic basis. By suitable selection of the barrier material (or combination of materials) in membrane 224 it is also possible to eliminate the purge valve 23 and allow the contaminant gases to continuously purge into the open environment as illustrated by the embodiment of FIG. 3. With this latter arrangement, the membrane can be located directly at the exit port for maximum collection of gases in chamber 330.

Figure 4:
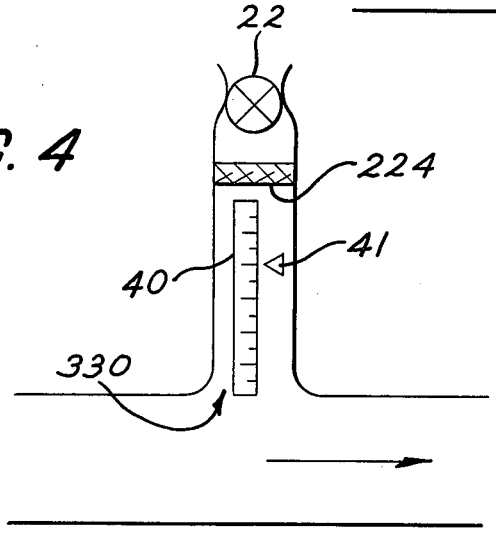

FIG. 4 illustrates an alternative arrangement of the invention based on the embodiment of FIG. 3 which utilizes an elongated temperature sensitive liquid crystal indicator 40 extending along the length of the gas accumulating chamber 330. An index marker 41, which is manually movable, is also provided. With this arrangement, the indicator modification being the subject of copending application Ser. No. 147,691, the degree of build-up of contaminant gases in chamber 330 is indicated by change in color of the liquid crystal along its length as the volume of contaminant gases increases, the temperature of the contaminant gases being relatively cooler than that of the compressed refrigerant vapor.

It will be appreciated that there has been shown and described suitable apparatus of a relatively simple nature for continuous monitoring of refrigerant systems to provide an indication of incipient system malfunction and also to improve system operating efficiency and reliability by purging of undesirable contaminant gases from the system.

In accordance with the patent statutes, there has been described what at present are considered to be the preferred embodiments of the invention. However, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. Condition monitoring apparatus for a halocarbon vapor compression refrigerant system having a refrigerant flow circuit including a compressor, a condenser, fluid expansion means and an evaporator, said monitoring apparatus comprising:

gas accumulating means positioned in the refrigerant circuit at a high point in the high pressure side to which non-condensable contaminant gases in the refrigerant stream migrate during operation of the system;

an inlet port coupling the gas accumulating means in fluid communication with the refrigerant circuit;

a purge valve secured to the gas accumulating means for exhausting unwanted contaminant gases accumulated therein;

a perm-selective membrane positioned across the inlet port to selectively admit predetermined contaminant gases into the gas accumulating means without significant loss of halocarbon vapor;

and indicia means coupled to the gas accumulating means for providing indicia representative of the degree of accumulation of the contaminant gases therein, whereby an in-situ indication of the onset of a system malfunction is provided.

2. Apparatus for a halocarbon vapor compression refrigerant system having a refrigerant flow circuit including a compressor, a condenser, fluid expansion means and an evaporator, said apparatus comprising:

gas accumulating means including an inlet port coupled in fluid communication with the refrigerant flow circuit on the high pressure side thereof at a point to which non-condensable contaminant gases in the refrigerant stream migrate during operation of the system;

and perm-selective membrane means included in the gas accumulating means to selectively pass predetermined contaminant gas compositions out of the refrigerant circuit without significant loss of the halocarbon vapor.

3. Apparatus in accordance with claim 2 in which the perm-selective membrane is positioned in the gas accumulating means at a point spaced away from the inlet port to form a gas accumulating chamber adjacent the inlet port but out of the main flow stream of the refrigerant circuit for collection of the contaminant gases from which chamber the contaminant gases permeate through the membrane out and away from the refrigerant circuit.

4. Apparatus in accordance with claim 3 in which the perm-selective membrane is positioned intermediate the inlet port and the remote end of the gas accumulating means so as to form two gas accumulating chambers, the first of which is adjacent the inlet port of the gas accumulating means and the second of which is on the opposite side of the membrane and serves to accumulate the gases permeating through the membrane.

5. Apparatus in accordance with claim 4 in which the gas accumulating means includes purge valve means in fluid communication with said second chamber for periodic purging of gas compositions accumulated therein.

6. Apparatus in accordance with claims 4 or 5 in which there is included means response to build-up of gases in the second chamber of the gas accumulating means to provide an indication representative of a predetermined level of gases in the second chamber, whereby an in-situ indication of the onset of a system malfunction is provided.

7. Apparatus in accordance with claim 2 in which the gas accumulating means includes purge valve means in fluid communication with the gas accumulating means for periodically removing the contaminant gas compositions accumulated therein after passage through the membrane.

8. Apparatus in accordance with claim 7 in which the gas accumulating means further includes indicia means responsive to the accumulation of gases in the gas accumulating means to provide indicia representative of the degree of accumulation of such gases, whereby an in-situ indication of the onset of a system malfunction is provided.

9. Apparatus in accordance with claim 4 or 5 in which the gas accumulating means includes means for indicating the degree of build-up of contaminant gases in the first chamber, whereby an in-situ indication of the onset of a system malfunction is provided.

* * * * *